US008312814B2

(12) United States Patent
Davis et al.

(10) Patent No.: US 8,312,814 B2
(45) Date of Patent: Nov. 20, 2012

(54) SIMULATED HAND GRENADE HAVING A MULTIPLE INTEGRATED LASER ENGAGEMENT SYSTEM

(75) Inventors: Eric R. Davis, Orlando, FL (US); Giles D. Jones, Vail, AZ (US); William W. Price, Upland, CA (US); Christopher A. Tomlinson, Vail, AZ (US); Peter M. Wallrich, San Jose, CA (US); Jeffrey E. Decker, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 592 days.

(21) Appl. No.: 12/206,339

(22) Filed: Sep. 8, 2008

(65) Prior Publication Data

US 2010/0058947 A1 Mar. 11, 2010

(51) Int. Cl.
*F42B 8/26* (2006.01)
*F41A 33/00* (2006.01)

(52) U.S. Cl. ..... 102/498; 102/529; 102/482

(58) Field of Classification Search ..... 102/498, 102/502, 529, 482; 434/11, 14, 15
See application file for complete search history.

(56) References Cited

U.S. PATENT DOCUMENTS

| | | | | |
|---|---|---|---|---|
| 3,596,078 | A * | 7/1971 | Owens | 362/184 |
| 4,014,262 | A | 3/1977 | Betts | |
| 4,823,401 | A | 4/1989 | Gammarino et al. | |
| 5,199,874 | A | 4/1993 | Campagnuolo et al. | |
| 5,246,372 | A * | 9/1993 | Campagnuolo et al. | 434/11 |
| 5,351,623 | A * | 10/1994 | Kissel et al. | 102/498 |
| 5,474,452 | A | 12/1995 | Campagnuolo | |
| 5,481,979 | A * | 1/1996 | Walder | 102/498 |
| 6,065,404 | A * | 5/2000 | Ripingill et al. | 102/498 |
| 6,411,424 | B1 | 6/2002 | Raj | |
| 6,579,097 | B1 | 6/2003 | Sampson et al. | |
| 6,965,542 | B1 * | 11/2005 | Harrington et al. | 367/127 |
| 7,191,708 | B2 * | 3/2007 | Ouliarin | 102/502 |
| 2007/0264616 | A1 | 11/2007 | Namgung | |
| 2008/0187888 | A1 | 8/2008 | Jones et al. | |
| 2009/0035730 | A1 | 2/2009 | Lindero | |
| 2009/0165664 | A1 | 7/2009 | Jones | |
| 2010/0003643 | A1 | 1/2010 | Seo | |
| 2010/0099059 | A1 | 4/2010 | Burford | |

OTHER PUBLICATIONS

Jones, "Method and Apparatus for Simulating Weapon Explosions Inside a Chamber," U.S. Appl. No. 11/553,697, 25 pages, filed Oct. 27, 2006.
Jones et al., "Simulated Mine," U.S. Appl. No. 12/266,175, 24 pages, filed Nov. 6, 2008.
Jones, USPTO "Office Action Summary," U.S. Appl. No. 11/553,697, Sent Apr. 16, 2010, 6 pages.
Jones et al., "Response Pursuant to 37 C.F.R. 1.111," U.S. Appl. No. 11/553,697, filed Jul. 16, 2010, 12 pages.
Jones et al., "Response Pursuant to 37 C.F.R. 1.116," U.S. Appl. No. 11/553,697, mailed Oct. 7, 2010.

* cited by examiner

*Primary Examiner* — James Bergin
(74) *Attorney, Agent, or Firm* — Schwegman Lundberg & Woessner, P.A.

(57) ABSTRACT

A hand grenade simulator includes a hand grenade simulator housing configured to simulate the appearance of a hand grenade. The hand grenade simulator also includes a trigger mechanism coupled to the hand grenade simulator housing. The hand grenade simulator further includes a timer coupled to the trigger mechanism. The hand grenade simulator additionally includes at least one transmitter coupled to the timer. The transmitter is operable to transmit the first signal simulating a hand grenade blast pattern a first amount of time after activation of the trigger mechanism.

11 Claims, 3 Drawing Sheets

SIMULATED HAND GRENADE HAVING A MULTIPLE INTEGRATED LASER ENGAGEMENT SYSTEM

TECHNICAL FIELD OF THE DISCLOSURE

This disclosure generally relates to training devices, and more particularly to a simulated hand grenade having a multiple integrated laser engagement system.

BACKGROUND OF THE DISCLOSURE

In order to maintain peak readiness war fighters often engage in training exercises. One common type of training uses Multiple Integrated Laser Engagement System ("MILES") equipment to simulate a battle. In a MILES simulation, war fighters use infrared transmitters (e.g., light emitting diodes (LEDs) or lasers) to simulate weapon fire. Because infrared signals emitted from the LEDs or lasers are used, weapon fire may comprise line-of-sight type signals. These signals may carry information about the shooter, firearm, and/or ammunition being simulated.

Unfortunately, current MILES equipment does not have a means to effectively simulate the use of offensive hand grenades as part of the training. This imposes a handicap on the war fighters and degrades the realism of the training. One solution involves the use of an RF emitter inside of the hand grenade. While the RF signal is able to simulate the omnidirectional blast pattern of a hand grenade, it also can penetrate obstacles capable of shielding soldiers from the effects of a real hand grenade blast. The RF signal also requires the war fighters to wear additional sensors to detect the RF signal. Another prior solution included the use of layered diodes. But this solution was hampered by the size of electronic components which did not allow for the replication of the size, look or feel of a reel hand grenade. Both designs also prevented the use of small quantities of explosives to replicate the hand grenade's explosive signature as well as the use of an M288 fuse often used with the M69 practice grenade.

SUMMARY OF THE DISCLOSURE

According to one embodiment of the disclosure, a hand grenade simulator includes a hand grenade simulator housing configured to simulate the appearance of a hand grenade. The hand grenade simulator also includes a trigger mechanism coupled to the hand grenade simulator housing. The hand grenade simulator further includes a timer coupled to the trigger mechanism. The hand grenade simulator additionally includes at least one transmitter coupled to the timer. The transmitter is operable to transmit the first signal simulating a hand grenade blast pattern a first amount of time after activation of the trigger mechanism.

Certain embodiments may provide one or more technical advantages. A technical advantage of one embodiment may be that a hand grenade simulator may be used in a multiple integrated laser engagement system (MILES) based battle simulation by emitting signals that may simulate the blast pattern of a corresponding real hand grenade. The hand grenade simulator may have a similar look, weight, and feel to the corresponding real hand grenade.

Certain embodiments may include all, some, or none of the above technical advantages. One or more other technical advantages may be readily apparent to one skilled in the art from the figures, descriptions, and claims included herein.

BRIEF DESCRIPTION OF THE DRAWINGS

A more complete understanding of the embodiments included in the disclosure will be apparent from the detailed description taken in conjunction with the accompanying drawings in which.

DETAILED DESCRIPTION OF EXAMPLE EMBODIMENTS

Figure 1:
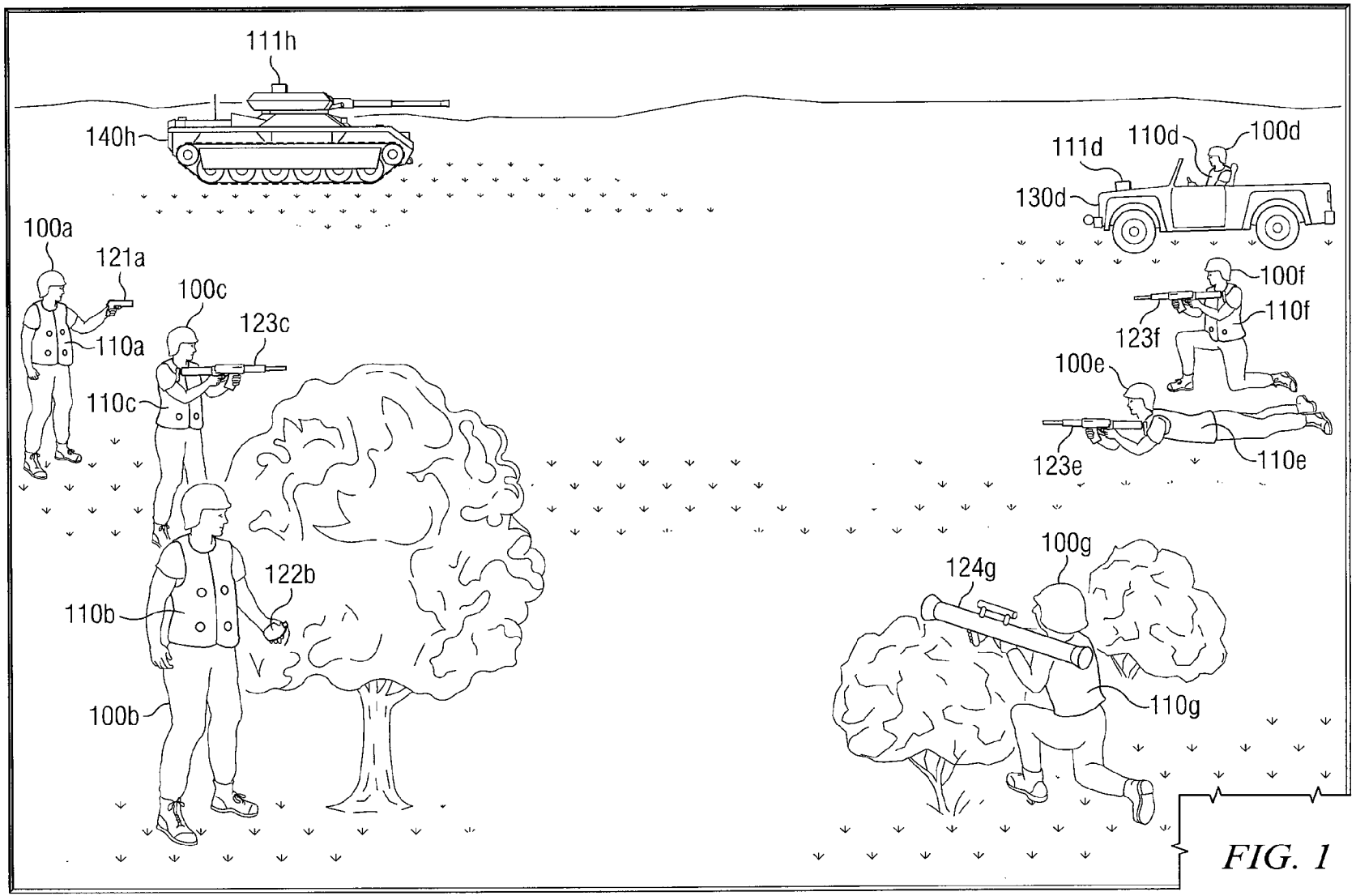
FIG. 1 depicts a birds-eye view of a MILES battle simulation, in accordance with particular embodiments.

FIG. 1 depicts a birds-eye view of a MILES battle simulation, in accordance with particular embodiments. The MILES simulation depicted in FIG. 1 comprises seven war fighters 100, vehicle 130*d* and tank 140*h*. Each war fighter 100 is wearing a sensor 110. Sensor 110 may include several individual sensors arranged so as to be able to detect signals emitted from one of the plurality of weapons wielded by one of the plurality of war fighters 100. In addition, both vehicles also include their own sensors; vehicle 130*d* includes sensor 111*d* and tank 140*h* includes sensor 111*h*.

Each war fighter 110 is wielding a weapon that may be able to emit signals for use in simulating a battle. For example, in the depicted embodiment the weapons may include transmitters that are able to transmit MILES signals. The weapons depicted herein include handgun 121*a*, hand grenade 122*b*, rifles 123*c*, 123*e*, 124*f*, and rocket launcher 124*g*, as well as the canon on tank 140*h*. As part of the simulation, each of the weapons may emit its own unique signal representing that weapon's respective war fighter 100, type of weapon, and/or ammunition. In a MILES battle simulation this signal may comprise one or more kill words. The kill words may be based on the characteristics of the real counterpart weapon. This may allow, for example, sensor 110*f* to know whether war fighter 100*f* was hit by hand gun 121*a* or by the canon of tank 140*h*. The kill words may be transmitted by an infrared, LED or laser transmitter located within or on the weapon. For example, rifle 123*c* may include an infrared transmitter mounted along the side of the barrel of rifle 123*c*. As another example, handgun 121*a* may include an infrared transmitter located inside the barrel of handgun 121*a*.

During the course of a simulation, war fighters 100 may be "killed" or "injured" based on the signals detected by their respective sensors 110. More specifically, sensors 110 may be able to determine the type of weapon, the type of ammunition, the range from the weapon to the sensor 110, and/or where the war fighter 100 has been hit (e.g., arm, chest, etc.). Based on this information, sensor 110 may be able to determine the extent of harm from the shot and thus whether the respective war fighter was killed or merely injured. For example, hand grenade 122*b*, if thrown at war fighter 100*f*, may kill war fighter 100*f*, but may only injure war fighters 100*e* and 100*g* because they are farther away from where hand grenade 122*b* was thrown. Similarly, sensors 111 may be able to determine whether the vehicle is "damaged," "destroyed," or "unaffected." For example, shooting tank 140*h* with handgun 121*a* would likely leave tank 140*h* unaffected while hitting tank 140*h* with rocket launcher 124*g* may damage or destroy tank 140*h*.

In order to increase the realism of a MILES simulation it may be desirable for the weapons to transmit kill words that properly emulate the characteristics of the respective real weapons. For example, the range and effect of the kill words transmitted by hand grenade 122*b* may emulate the blast pattern of a real hand grenade. More specifically, a particular real hand grenade may have an associated kill radius of 5 meters, a casualty radius of 15 meters, and a fragmentation dispersion radius of 230 meters. Accordingly, this blast pattern may be simulated by the kill words transmitted by hand grenade 122*b*. Furthermore, sensor 110 of a particular war fighter 100 may be able to determine the extent of the damage to war fighter 100 by determining which of the radii the respective war fighter 100 is within. The emulation may involve infrared transmitters within hand grenade 122*b* transmitting the pulses that comprise the kill words. The emulation may also involve controlling the power with which the infrared transmitters generate the infrared pulses that comprise the kill words so as to control the range within which the kill words may be detected by sensors 110 or 111. Thus, when a war fighter deploys hand grenade 122*b*, a realistic simulation of the damage it may cause is generated.

In particular embodiments, sensors 110 may be distributed throughout vests, jackets, pants and/or any other appropriate garments or equipment worn by war fighters 100. The garments may comprise a plurality of infrared receivers arrayed to more accurately detect infrared signals. Sensor 110 may also include any hardware, software and/or encoded logic needed to interpret and/or process the infrared signals received by the plurality of infrared receivers. Similarly, sensor 111*d*, of vehicle 130*d*, may comprise a plurality of infrared receivers dispersed throughout the outside of vehicle 130*d*; and sensor 111*h*, of tank 140*h*, may comprise a plurality of infrared receivers displaced throughout the outside surface of tank 140*h*.

Figure 2:
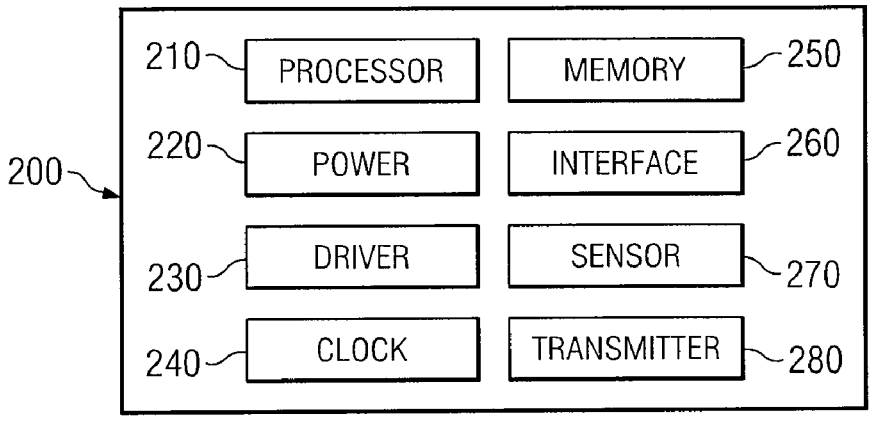
FIG. 2 depicts a block diagram of the electronic components of a hand grenade simulator, in accordance with particular embodiments.

FIG. 2 depicts a block diagram of the electronic components of a hand grenade simulator, in accordance with particular embodiments. In the depicted embodiment, hand grenade simulator 200 comprises processor 210, power supply 220, driver 230, clock 240, memory 250, interface 260, sensor 270, and transmitter 280. These components may work together as part of a MILES battle simulation to allow hand grenade simulator 200 to transmit kill words at the appropriate time and power level using transmitter 280.

Processor 210 may comprise any hardware, software, and/or encoded logic operable to provide processing functionality for hand grenade simulator 200. Depending on the embodiment, processors 210 may be a programmable logic device, a controller, a microcontroller, a microprocessor, any suitable processing device or circuit, or any combination of the preceding. Processor 210 may manage and implement, either alone or in conjunction with other hand grenade simulator components, the operation of hand grenade simulation functionality. Such functionality may include simulating the blast pattern of a real hand grenade in a MILES battle simulation. More specifically, processor 210 may determine when to transmit the kill words, what power to use when transmitting the kill words, whether multiple kill words should be transmitted, how fast the kill words should be transmitted, and/or what kill words to transmit.

Power supply 220 may include any suitable combination of hardware, software, and/or encoded logic operable to provide power to hand grenade simulator 200. In particular embodiments, power supply 220 may include batteries or any other form of power storage. In some embodiments, power supply 220 may be able to regulate power from a power source so that hand grenade simulator 200 is supplied with the appropriate power level. In particular embodiments, power supply 220 may comprise, or be coupled to, rechargeable batteries. Accordingly, power supply 220 may be able to regulate the power from an external power source to re-charge the rechargeable batteries. For example, hand grenade simulator 200 may be connected to a power outlet of a vehicle (e.g., vehicle 130*d*), power supply 220 may regulate the power from the power outlet so that the batteries are safely recharged.

Driver 230 may include any suitable combination of hardware, software, and/or encoded logic operable to drive one or more transmitters 280. In particular embodiments, driver 230 may communicate with processor 210 and/or memory 250 to determine when and what is to be transmitted. Using this information driver 230 may be able to determine how transmitters 280 need to be driven in order to transmit the appropriate kill words at the desired range to accurately simulate a real hand grenade.

Clock 240 may include any suitable combination of hardware, software, and/or encoded logic operable to provide clock functionality. Such clock functionality may include a system clock used to synchronize the various components of hand grenade simulator 200. In some embodiments clock 240 may operate a countdown timer that determines when to trigger the transmission of the kill words after the spoon has been released.

Memory 250 may include any suitable combination of hardware, software, and/or encoded logic operable to store information needed by hand grenade simulator 200. In particular embodiments, memory 250 may include any form of volatile or non-volatile memory including, without limitation, magnetic media, optical media, random access memory (RAM), read only memory (ROM), removable media, or any other suitable local or remote memory component. Memory 250 may store any suitable data or information including software and encoded logic utilized by hand grenade simulator 200. For example, memory 250 may maintain a listing, table, or other organization of information used to store one or more different kill words. In some embodiments, the kill words stored by memory 250 may be updated or changed based on different real hand grenades or changes to a particular real hand grenade. In particular embodiments, memory 250 may store, or log, information indicative of when the kill words were transmitted.

Interface 260 may include any suitable combination of hardware, software and/or encoded logic operable to allow the exchange of information and/or data between any components coupled to or a part of hand grenade simulator 200. For example, interface 260 may include any port or connection real or virtual. In particular embodiments, interface 260 may allow a user to program and/or upgrade software or logic executed by hand grenade simulator 200. For example, a user may connect hand grenade simulator 200 to a computer via interface 260. This may allow new kill words or a change in the length of time of a countdown timer to be uploaded. Thus, the same hand grenade simulator 200 may be used to simulate different types of real hand grenades or different types of scenarios. In particular embodiments, interface 260 may also be used to load weapon and/or user identifier codes.

Sensor 270 may comprise any suitable combination of hardware, software, and/or encoded logic operable to detect particular events, such as triggering events. For example, in particular embodiments, sensor 270 may comprise a sensor operable to detect the removal of the spoon from hand grenade simulator 200. The spoon of hand grenade simulator 200 may provide similar functionality as a spoon of a real hand grenade. More specifically, removing or releasing the spoon from hand grenade simulator 200 indicates that the war fighter desires to begin the countdown to detonation. In some embodiments, sensor 270 may comprise a sensor operable to detect the detonation of a charge within a blast tube of hand grenade simulator 200. For example, in some embodiments hand grenade simulator 200 may use a real fuse along with a small simulation charge stored within a blast tube. The fuse may ignite the simulation charge in the same way it would ignite the full charge of a real hand grenade or the simulation charge of a practice hand grenade. Sensor 270 may be able to detect the detonation of the small charge and signal that the kill words should be transmitted by transmitters 280.

Transmitter 280 may comprise any suitable combination of hardware, software, and/or encoded logic operable to transmit kill words. In particular embodiments, transmitter 280 may comprise several light emitting diodes (LEDs) displaced along the housing of hand grenade simulator 200. Accordingly, the LEDs may be able to generate an infrared burst that represents particular kill words associated with hand grenade simulator 200. Because transmitters 280 may be displaced along the housing of hand grenade simulate 200 they may be able to effectively simulate the omni-directional blast pattern of a real hand grenade. Driver 230 may be coupled to transmitters 280 so that transmitters 280 are properly driven based on the kill words and the desired range.

Figure 3:
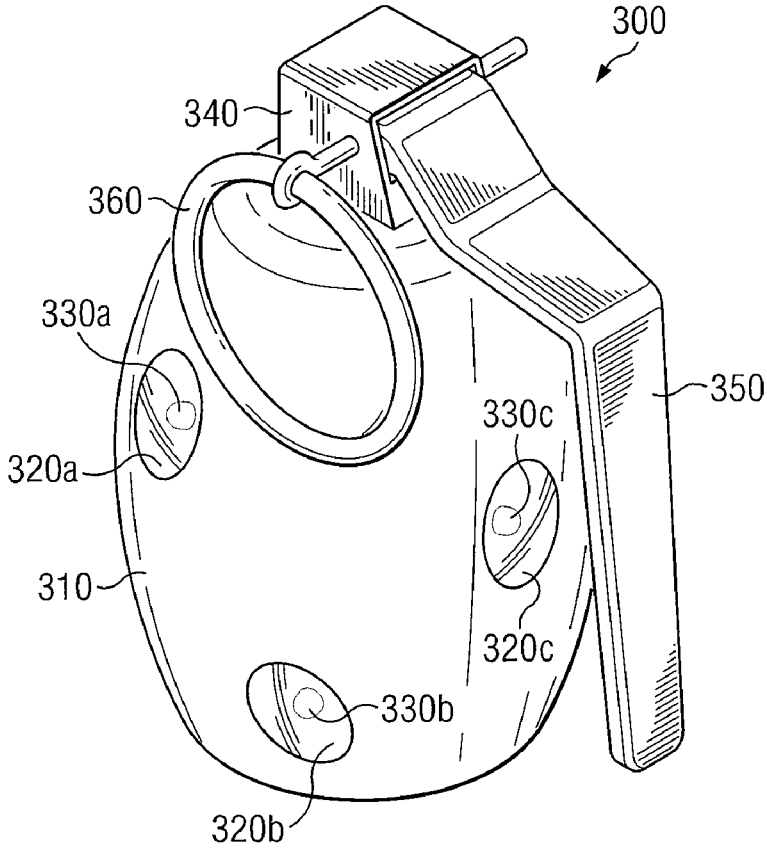
FIG. 3 depicts a profile view of a hand grenade simulator, in accordance with particular embodiments.

FIG. 3 depicts a profile view of a hand grenade simulator. Hand grenade simulator 300 comprises housing 310, chamfered openings 320, transmitters 330, fuse 340, spoon 350, and pin 360. These components of hand grenade simulator 300 may provide a war fighter with a hand grenade having a similar look, feel, and weight compared to an actual hand grenade (e.g., an M67 hand grenade). Thus, as war fighters practice using hand grenade simulator 300 they are gaining experience in throwing and handling real hand grenades.

As in a real hand grenade, pin 360 of hand grenade simulator 300 keeps spoon 350 secured. Once spoon 350 has been removed, hand grenade simulator 300 becomes active and a countdown mechanism begins. In particular embodiments the countdown mechanism may comprise a countdown timer within housing 310. The countdown timer may start upon detecting the release of spoon 350 and when it reaches "0" it may trigger the detonation of a simulation charge and/or the transmittal of the kill words. In such embodiments, fuse 340 may comprise a fuse simulator. In some embodiments the countdown mechanism may comprise the same fuse used with a real hand grenade. For example, fuse 340 may be an M288 fuse used with an M69 practice grenade. In a real hand grenade, fuse 340 would trigger the detonation of explosives contained within the housing of the grenade after a certain amount of time. Similarly, in hand grenade simulator 300 fuse 340 may trigger the detonation of a simulation charge contained within a blast tube to simulate the flash, bang, and/or smoke of a real hand grenade. The detonation of the simulation charge may be detected by a sensor that then signals for the transmittal of the kill words.

Regardless of the countdown mechanism used, once it is determined that the kill words are to be transmitted transmitters 330 may be driven to emit the kill words. In some embodiments, transmitter 330 may comprise LED transmitters. Chamfered openings 320 may allow the infrared light emitted from LED type transmitters 330 to be spread out in an omni-directional manner that allows the range of the kill words to replicate the kill zone and blast radius of a typical hand grenade. For example, in particular embodiments, chamfered opening 320 may be opened up 140 degrees. This may optimize the dispersion pattern of infrared light from transmitters 330.

In particular embodiments, the indentation created by chamfered openings 320 may be covered by a clear covering. For example, the clear covering may include plastic, glass or any other rigid, durable, and transparent material. The covering over chamfered openings 320 may provide housing 310 with a surface that, to a war fighter, feels similar to the surface of a real hand grenade. This feel is maintained while still allowing transmitters 330 to be able to emit the infrared light needed to transmit the kill words. In particular embodiments the clear coverings may be such that they may be removed or replaced to allow for the maintenance of transmitters 330 or replacement of the clear coverings if they become damaged.

Figure 4:
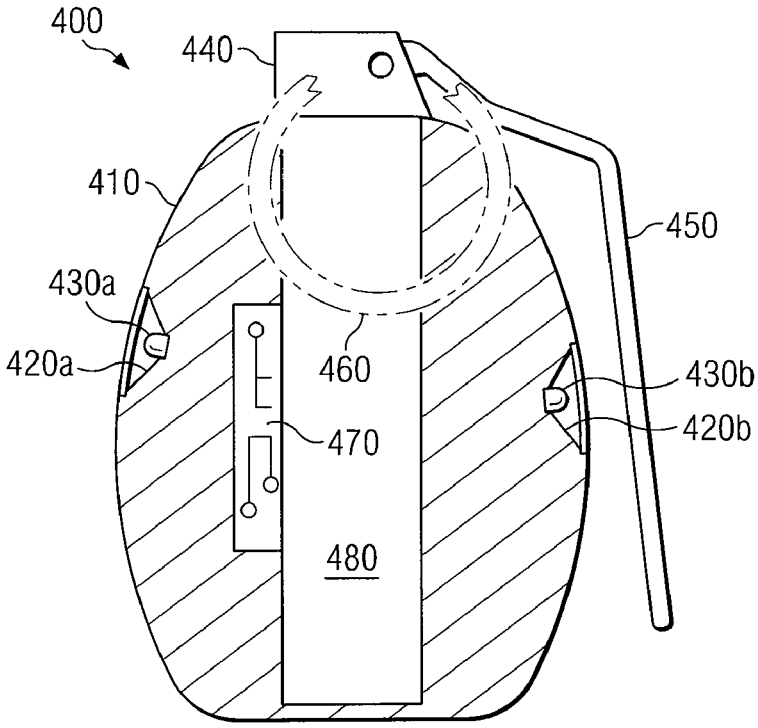
FIG. 4 depicts a cutaway side profile view of the hand grenade simulator depicted in FIG. 3, in accordance with particular embodiments.

FIG. 4 is a cutaway side profile view of the hand grenade simulator depicted in FIG. 3. As was seen in hand grenade simulator 300, hand grenade simulator 400 comprises housing 410, chamfered openings 420, LEDs 430, fuse 440, spoon 450, and pin 460. These components are similar to, and provide similar functionality as, the corresponding components depicted in FIG. 3. In addition, within hand grenade simulator 400 can be seen blast tube 480 and control board 470 which were not visible in hand grenade simulator 300.

Blast tube 480 may comprise a hollow steel tube which may be filled with a small amount of explosives (previously referred to as a simulation charge). The simulation charge may be detonated to simulate the flash, bang, and/or smoke of a real hand grenade. In some embodiments, the simulation charge may be detonated by fuse 440. In particular embodiments, the simulation charge may be detonated after a countdown timer determines that the simulation charge should be detonated. Blast tube 480 may be strong enough to channel the blast from the simulation charge out of blast tube 480 through a release point. This may allow blast tube 480 to protect the control board 470 and any other components within housing 410 when the simulation charge is detonated. In particular embodiments, blast tube 480 may be open at a bottom end opposite fuse 440 through which the explosive gases may be channeled (e.g., the release point). This open end may be covered by a screen to prevent matter from being projected out of hand grenade simulator 400 through the opening in blast tube 480.

Control board 470 may comprise various electronic components (e.g., one or more of the components depicted in FIG. 2) used to control the transmittal of the kill words. For example, control board 470 may include a countdown timer that starts when spoon 450 is released and then signals for the transmittal of the kill words once it reaches "0." As another example, control board 470 may include memory that stores the kill words.

Modifications, additions, or omissions may be made to the various hand grenade simulators depicted in FIGS. 2-4 without departing from the scope of this disclosure. The components of a hand grenade simulator may be integrated or separated. Moreover, the operations of a hand grenade simulator may be performed by more, fewer, or other components. For example, the operations of processor 210 and transmitter 280 may be performed by one component, or the operations of processor 210 may be performed by more than one component. Additionally, operations of a hand grenade simulator may be performed using any suitable logic comprising software, hardware, and/or other logic. As used in this document, "each" refers to each member of a set or each member of a subset of a set.

Figure 5:
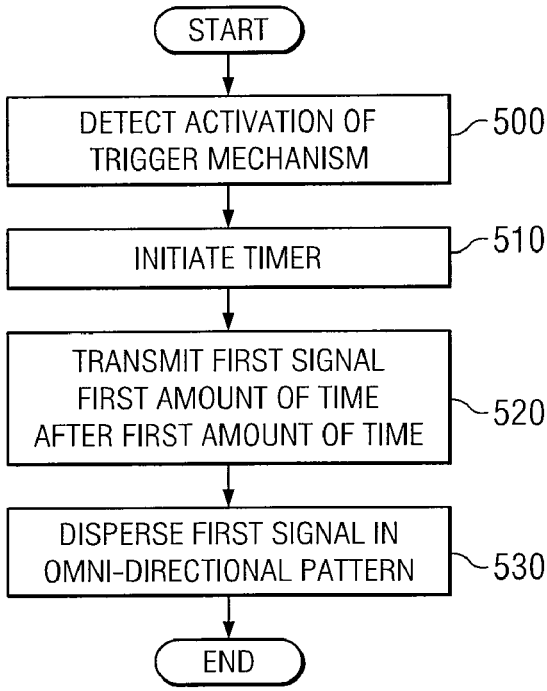
FIG. 5 depicts a flowchart illustrating a method of implementing a hand grenade simulator, in accordance with particular embodiments.

FIG. 5 depicts a flowchart illustrating a method of implementing a hand grenade simulator, in accordance with particular embodiments. The depicted method begins at step 500 with the detection of the activation of a trigger mechanism associated with the hand grenade. In particular embodiments this may occur when a user removes the spoon from the hand grenade simulator.

At step 510 a timer is initiated. In some embodiments, the timer may be a countdown timer. The length of time which the timer counts down may approximate the amount of time between activation and detonation of a real hand grenade. In some embodiments, the timer may be a fuse. For example, an M228 fuse used with M69 practice grenades.

At step 520 a first signal simulating a hand grenade blast pattern is transmitted after the timer has indicated the passing of a first amount of time. In some embodiments the timer may be able to directly initiate the transmission of the first signal. For example, if the timer is a countdown timer then when the timer reaches "0" it may signal a transmitter to transmit the first signal. In particular embodiments the timer may be able to indirectly initiate the transmission of the first signal. For example, if the timer is a fuse then when the fuse detonates a simulation charge a sensor may detect the detonation of the simulation charge and then initiate the transmission of the first signal.

In particular embodiments the first signal may comprise a Multiple Integrated Laser Engagement System ("MILES") signal. As discussed above MILES uses kill words transmitted by light. Accordingly, the transmitter used to transmit the first signal may use light to transmit the signal containing the kill words. For example, the transmitter may include a light emitting diode (LED).

At step 530 the first signal is dispersed in an omni-directional pattern. This omni-directional pattern may simulate the blast pattern of a real hand grenade. For example, if the transmitter is an LED the first signal may be dispersed via a chamfered opening surrounding the LED. Other embodiments may use different techniques for dispersing the signal. For example a lens may be used to disperse the light emitted from the transmitter, or the transmitter may itself sufficiently disperse the emitted light.

Some of the steps illustrated in FIG. 5 may be combined, modified or deleted where appropriate, and additional steps may also be added to the flowchart. Additionally, steps may be performed in any suitable order without departing from the scope of particular embodiments.

Although several embodiments have been illustrated and described in detail, it will be recognized that substitutions and alterations are possible without departing from the spirit and scope of particular embodiments, as defined by the following claims.

What is claimed is:

1. A hand grenade simulator comprising:

a hand grenade simulator housing defining an exterior shape that is substantially similar to the shape of a selected hand grenade;

a blast tube within the hand grenade simulator housing, the blast tube extending along a central axis of the hand grenade simulator housing, the blast tube defining at least one open end that opens through the hand grenade simulator housing;

a simulation charge disposed in the blast tube;

a trigger mechanism coupled to the hand grenade simulator housing, the trigger mechanism coupled to the simulation charge to detonate the simulation charge upon reception of a detonate signal;

a plurality of transmitters coupled to the hand grenade simulator housing outside of the blast tube and away from the open end of the blast tube, the transmitters being configured to, upon reception of a transmit signal, transmit a blast signal in a plurality of directions that extend away from the hand grenade simulator housing and away from the open end of the blast tube in a pattern associated with a hand grenade blast pattern of the hand grenade, the blast signal comprising a Multiple Integrated Laser Engagement System ("MILES") signal; and a trigger activating timer coupled to the trigger mechanism to time a first amount of time and, in association with the passing of the first amount of time, to provide the transmit signal to the plurality of transmitters, and to time a second amount of time and, in association with the passing of the second amount of time, to provide the detonate signal to detonate the simulation charge.

2. A hand grenade simulator comprising:

a hand grenade simulator housing defining an exterior shape that is substantially similar to the shape of a selected hand grenade;

a blast tube within the hand grenade simulator housing, the blast tube extending along a central axis of the hand grenade simulator housing, the blast tube defining at least one open end that opens through the hand grenade simulator housing;

a simulation charge disposed in the blast tube;

a trigger mechanism coupled to the hand grenade simulator housing, the trigger mechanism coupled to the simulation charge to detonate the simulation charge upon reception of a detonate signal;

a transmitter coupled with and disposed along an outer surface of the hand grenade simulator housing outside of the blast tube and away from the open end of the blast tube, the transmitter configured to, upon reception of a transmit signal, transmit a blast signal in a pattern configured to simulate a hand grenade blast pattern; and a trigger activating timer coupled to the trigger mechanism to time a first amount of time and, in association with the passing of the first amount of time, to provide the transmit signal to transmitter, and to time a second amount of time and, in association with the passing of the second amount of time, to provide the detonate signal to detonate the simulation charge.

3. The hand grenade simulator of claim 2, wherein the trigger activating timer comprises a fuse configured to detonate the simulation charge after the first amount of time has passed.

4. The hand grenade simulator of claim 2, wherein the apparatus further comprises a sensor operable to detect the simulation blast from the simulation charge.

5. The hand grenade simulator of claim 2, wherein the transmitter comprises at least one light emitting diode.

6. The hand grenade simulator of claim 2, further comprising at least one chamfered opening disposed along an outer surface of the hand grenade simulator housing, the at least one chamfered opening sized to house the transmitter.

7. The hand grenade simulator of claim 6, wherein the at least one chamfered opening comprises a chamfered opening of approximately 140 degrees.

8. The hand grenade simulator of claim 2, wherein the blast signal comprises a Multiple Integrated Laser Engagement System ("MILES") signal.

9. The hand grenade simulator of claim 2, wherein the trigger mechanism comprises a spoon defining a substantially similar shape as a spoon of the hand grenade.

10. The hand grenade simulator of claim 2, wherein the trigger activating timer comprises a count down timer.

11. The hand grenade simulator of claim 2, wherein the transmitter is one of a plurality of transmitters configured to transmit the blast signal in a pattern associated with a hand grenade blast pattern of the hand grenade.

* * * * *